United States Patent [19]

Shinozaki et al.

[11] 4,095,304

[45] Jun. 20, 1978

[54] HAND SWEEPER

[76] Inventors: Mamoru Shinozaki, No. 1-35, Sakuradai, Nerima-ku, Tokyo; Yuichi Takahama, No. 332-90, Ohaza sunashinden, Kawagoe-shi, Saitama-ken; Hachiro Tubaki, No. 813-1440, Ohaza fujima, Kawagoe-shi, Saitama-ken; Kazuo Nagasawa, c/o Atorasuso No. 16-33, 2-chome, Nukui, Nerima-ku, Tokyo; Yasao Mikami, c/o Ohkawa No. 28-2, 2-chome, Narimasu, Nerima-ku, Tokyo, all of Japan

[21] Appl. No.: 766,566

[22] Filed: Feb. 7, 1977

[30] Foreign Application Priority Data

| | | |
|---|---|---|
| Feb. 10, 1976 | Japan | 51-14957[U] |
| Feb. 14, 1976 | Japan | 51-16191[U] |
| Feb. 27, 1976 | Japan | 51-22763[U] |

[51] Int. Cl.[2] ..... A47L 11/33

[52] U.S. Cl. ..... 15/48

[58] Field of Search ..... 15/41 R–48

[56] References Cited

U.S. PATENT DOCUMENTS

| | | | |
|---|---|---|---|
| 743,838 | 11/1903 | Duffy | 15/41 R |
| 2,181,455 | 11/1939 | Gussack | 15/48 |
| 2,962,740 | 12/1960 | Plantholt | 15/41 R |
| 3,003,170 | 10/1961 | Lathrop | 15/41 R |
| 3,034,163 | 5/1962 | Stevens et al. | 15/41 R |
| 3,789,454 | 2/1974 | Drappeau et al. | 15/41 R |

*Primary Examiner*—Edward L. Roberts

[57] ABSTRACT

A hand sweeper according to the present invention comprises a base in the form of a dust box having a rotary brush and driving wheels for transmitting their rotation to the rotary brush and a cover body for covering the dust box. The cover body has a handle pivotably attached thereto and is removably connected to the dust box.

7 Claims, 7 Drawing Figures

HAND SWEEPER

This invention relates to hand sweepers for carpets and more particularly, to a hand sweeper wherein dust is swept into a dust box thereof by a rotary brush.

This kind of hand sweepers known heretofore have a disadvantage that in throwing away the dust collected in the dust box, there is a need of lifting up the whole sweeper to open downwardly the dust box relative to the sweeper body.

A main object of the present invention is to provide a hand sweeper having a base in the form of a dust box and a cover which are capable of separating from each other in order to eliminate the above mentioned disadvantage and to make it easy to throw away the dust in the dust box.

According to the present invention there is provided a hand sweeper comprising a base in form of a dust box having front and rear walls and side walls, a rotary brush rotatably supported on the side walls of the dust box, driving wheels for transmitting their rotation to the rotary brush to sweep dust into the dust box, a cover body for covering the dust box, a handle pivotably attached to the cover body and means for removably connecting the cover body to the base.

Preferably, the connecting means include hooks extending upwardly from the base adjacent to its front edge, corresponding projections on the inner surface of the cover body for engaging the hooks, a hook-like slot formed in the rear wall of the base and a spring urged latch slidably mounted in the cover body so as to be capable of moving between a position in which it is engaged by the hook-like slot to connect the cover to the base and a position in which the latch is disengaged from the hook-like slot to allow removal of the cover from the base.

In a preferred embodiment according to the present invention, the cover body includes a brush cleaning comb having its teeth engaging the rotary brush on its opposite sides and attached to the inner surface thereof in order to make it possible to remove the comb along with the cover body relative to the base.

Further advantageous features of the present invention will become more apparent from the following description of a preferred embodiment of the hand sweeper according to the invention taken in conjunction with the accompanying drawing in which.

Figure 1:
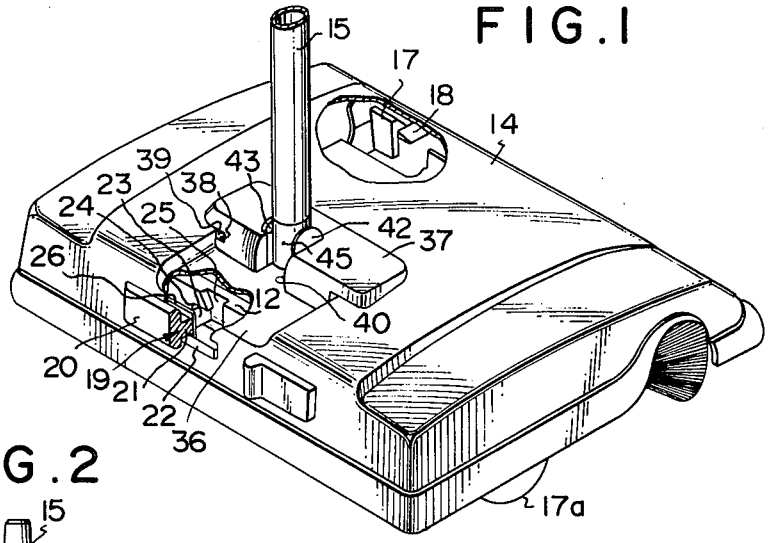
FIG. 1 shows a partially broken perspective view of a hand sweeper according to the present invention.
Figure 2:
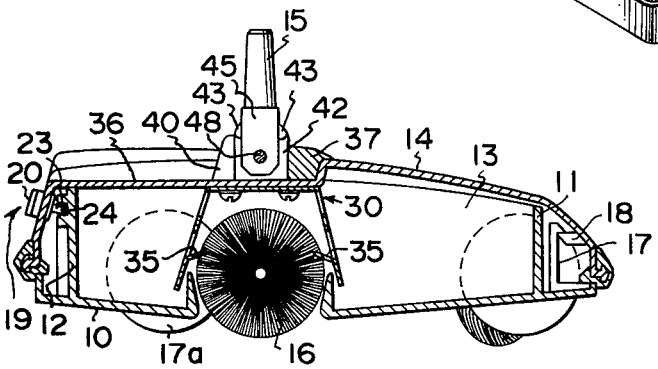
FIG. 2 shows a vertical cross-section of the hand sweeper shown in FIG. 1.
Figure 3:
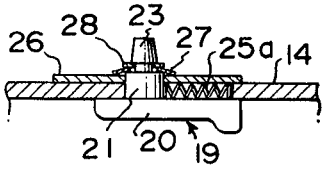
FIG. 3 shows a horizontal cross-section of a latch used for connection of a cover body to a base.
Figure 4:
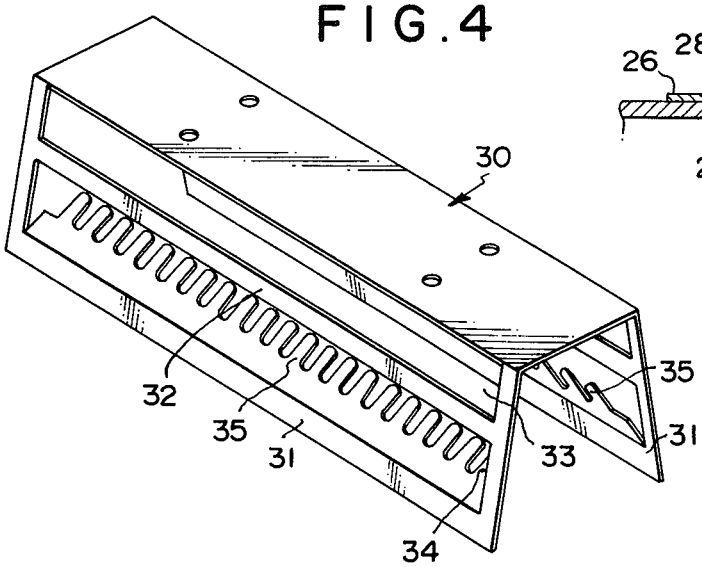
FIG. 4 shows a perspective view of a brush cleaning comb attached to the cover body.
Figure 5:
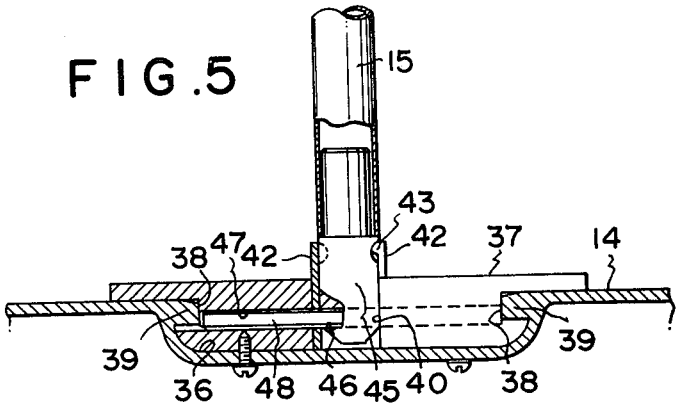
FIG. 5 shows a partial cross-section of a handle attaching arrangement.

Referring to the drawing, a hand sweeper according to the present invention comprises a base 10 in the form of a dust box having front and rear walls 11 and 12, and side walls 13, a cover body 14 for covering the dust box 10 and a handle 15 for manipulating the sweeper. Preferably, the base 10 and the cover body 14 are made of any suitable plastic material. A rotary brush 16 extends horizontally across the base between the side walls 13 thereof and is rotatably supported on the side walls 13. Driving wheels 16 (only one of which is shown in FIGS. 1 and 2) are provided for transmitting their rotation to the rotary brush 16 to sweep dusts into the dust box 10.

The base is provided with upwardly extending hooks 17 adjacent to the front edge thereof, the hooks being engaged by corresponding projections 18 extending backwardly from the inner surface of the front portion of the cover body 14. A latch 19 has an integral knob 20 and a shank portion 21 which is slidably received in a horizontally extending slot 22 formed in the rear portion of the cover body 14. The shank portion 21 is integrally formed with a projection 23 which engages a hook-like slot 24 formed in the rear wall 12 of the base 10 to lock the cover body 14 to the base 10. The rear wall 12 is also provided with a guide slot 25 for introducing the projection 23 of the latch 19 into the hook-like slot 24. A spring 25a is disposed in the slot 22 between the shank portion 21 and one of the ends of the slot 22 to urge the latch 19 in the left-hand direction. A backing plate 26 which is fitted on the shank portion 21 and positioned adjacent the inner surface of the cover body 14, is held in position through a spring washer 27 by a retainer ring 28 fitted in an annular groove 29 which is formed between the shank portion 21 and its projection 23. This arrangement serves to prevent the latch 19 from coming out of the slot 22.

A brush cleaning comb 30 is made of metal or plastic material and is secured to the inner surface of the cover body 11 above the rotary brush 16. The brush cleaning comb has oppositely spaced frame portions 31 and 31, each of which is provided with a bar 32 extending parallel to the rotary brush to define upper and lower openings 33 and 34 therein, and upwardly inclined teeth 35 extending from the lower edge of the lower opening 34 toward each of the opposite sides of the brush to engage the rotary brush 16.

The cover body 14 is provided on its upper surface with a recess 36 extending from the rear portion to the center portion of the cover body 14.

Figure 6:
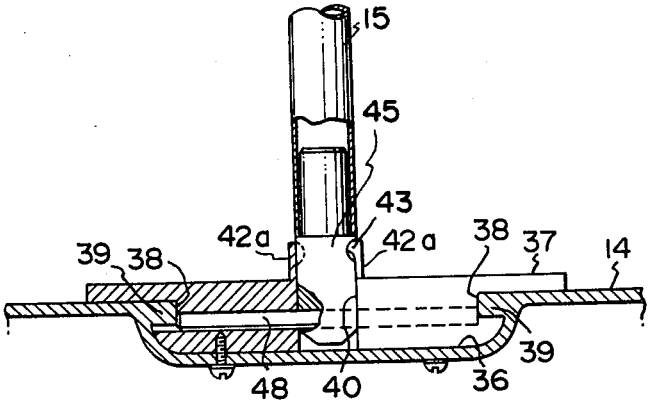
FIG. 6 is a view similar to FIG. 5 but showing another embodiment of the handle attaching arrangement.
Figure 7:
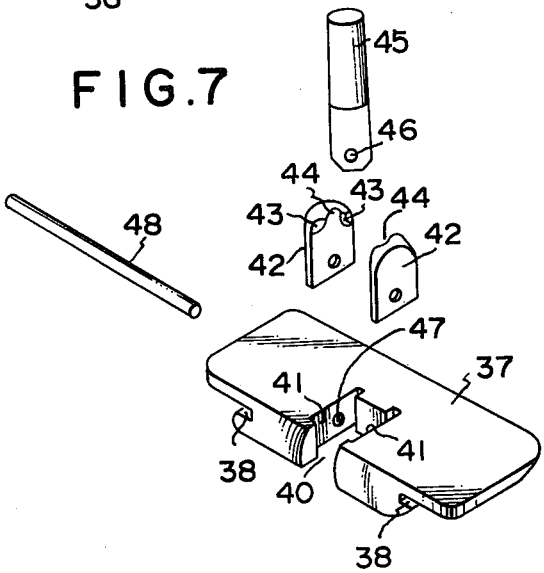
FIG. 7 is an exploded view of parts of the handle attaching arrangement shown in FIG. 5.

A bearing block 37 is made of plastic material and is formed with a pair of horizontal grooves 38 and 38 on the opposite sides thereof, which engage a pair of projections 39 and 39 extending from the cover body 14 toward the recess 36 in its center portion. The bearing block 37 has a backwardly opened notch 40 formed therein which permits swing movement of the handle from a substantially vertical position to a position parallel to the surface of the recess 36. The notch 40 is formed on its opposite sides with recesses 41 in which a pair of stopper elements 42 can be inserted. Each of the stopper elements 42 is provided with a pair of retainer projections 43 spaced from each other to define a retaining recess 44 there-between for retaining the shank 45 of the handle 15 in the vertical position. The handle shank 45 has a transverse opening 46 formed therein which is aligned with an opening 47 formed in the bearing block 37. Thus, the shank 45 is pivotably supported on the bearing block 37 by disposing the handle shank 45 between the stopper elements 42 and 42 and inserting a pivot pin or shaft 48 through the stopper elements 42 into the openings 46 and 47 in the shank 45 and the bearing block 37. Alternatively, stopper elements 42a may be formed integrally with the bearing block 37 as shown in FIG. 6 of the drawing. Although in the preferred embodiment shown in the drawing, the handle shank 45 is pivotably attached to the bearing block 37, the handle 15 may be pivoted directly to the bearing block 37 by the pivot pin 48.

In assembly, the bearing block 37 with the handle pivoted thereto is positioned in the recess 36 by sliding the block 37 along the recess to its center portion to engage the side grooves 38 with the projections 39 and is secured to the cover body by means of set screws. This arrangement makes attachment of the handle to the cover body 14 easy.

In use, the sweeper according to the present invention is manually moved back and forth by operation of the handle 15 to rotate the driving wheels 17a, thereby to transmit its rotation to the rotary brush 16. The rotation of the brush 16 causes dust to sweep through the teeth 35 of the comb into the dust box 10. The bar 32 serves to prevent the dust collected in the dust box 10 from escaping therefrom. After the sweeping operation has been completed, the knob 20 is moved in the right-hand direction against the action of the spring 25a to effect disengagement of the projection 23 from the hook-like slot 24 and thereafter, the cover body 14 is raised relative to the base 10 to separate from the base. The comb 30 can be removed along with the separated cover body 14 to make it easy to remove from the comb 30, dust, waste threads or the like deposited or entagled on the teeth thereof. The collected dust can be completely thrown away from the dust box 10 because it has no longer any obstruction such as the comb.

In assembly, after the projections 18 on the cover body 14 have been engaged the hooks 17 on the base 10, the cover body 14 is pushed down toward the base 10 so that the latch portion 23 can be introduced through the guide slot 25 into the hook-like slot 24. Thereafter the latch 19 is moved by the action of the spring 25a in the left-hand direction to engage the latch portion 23 with the hook-like slot 24, thereby to connect the cover body 14 to the base 10.

It will be noted from the above description that there has been provided a hand sweeper in which separation of the cover body from the base makes it possible to completely throw away collected dust from the base without getting hands dirty.

We claim:

1. A hand sweeper comprising a base in the form of a dust box having front and rear walls and side walls, a rotary brush rotatably supported on the side walls and extending transversely of the dust box, driving wheels for transmitting their rotation to said rotary brush to sweep dust into said dust box, a cover body for covering said base, a handle pivotably attached to said cover body, and connecting means for removably connecting said cover body to said base, said connecting means including hooks extending upwardly from said base adjacent to its front edge, corresponding projections on the inner surface of said cover body for engaging said hooks, a hook-like slot formed in said rear wall of said base, and a spring urged latch slidably mounted in said cover body so as to be capable of moving between a position in which it is engaged by said hook-like slot to connect said cover to said base and a position in which said latch is disengaged from said hook-like slot to allow removal of said cover from said base.

2. A hand sweeper according to claim 1 wherein said cover body includes a brush cleaning comb secured to the inner surface thereof above said rotary brush, said comb having a pair of oppositely spaced frame portions with teeth engaging said rotary brush on its opposite sides.

3. A hand sweeper according to claim 2 wherein each of said frame portions of the comb has a horizontally extending bar for preventing dusts collected in the dust box from escaping from it.

4. A hand sweeper according to claim 3, wherein said bar extends parallel to the rotary brush to define upper and lower openings therein, said teeth extending obliquely upwardly from the lower edge of the lower opening.

5. A hand sweeper according to claim 1 wherein said cover body has a recess formed on the upper surface thereof and said handle has a shank connected thereto, said shank being pivotably connected to a bearing block secured to said cover body in said recess.

6. A hand sweeper according to claim 5 wherein said bearing block includes a backwardly opened notch formed therein, a pair of recesses formed in the opposite sides of said notch, a pair of spaced stopper elements inserted in said recesses of said notch for retaining said handle shank disposed there-between in a vertical position and said handle shank is pivotably connected to said bearing block by a pivot pin extending transversely through said shank, bearing block and stopper elements.

7. A hand sweeper according to claim 6 wherein said cover body has a pair of projections extending from the upper surface thereof toward said recess and said bearing block has a pair of grooves formed in the opposite sides thereof for slidably engaging said projections to connect said bearing block to said recess of the cover body.

* * * * *